US005921310A

United States Patent [19]

Kats et al.

[11] Patent Number: 5,921,310

[45] **Date of Patent: *Jul. 13, 1999**

[54] PROCESS FOR PRODUCING A DIRECTIONALLY SOLIDIFIED CASTING AND APPARATUS FOR CARRYING OUT THIS PROCESS

[75] Inventors: Edvard L. Kats, Moscow, Russian Federation; Maxim Konter, Untersiggenthal; Joachim Rösler, Unterehrendingen, both of Switzerland; Vladimir P. Lubenets, Miscow, Russian Federation

[73] Assignee: ABB Research Ltd., Zurich, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,702

[22] Filed: Sep. 26, 1997

Related U.S. Application Data

[63] Continuation of application No. 08/609,832, Mar. 1, 1996, abandoned.

[30] Foreign Application Priority Data

Jun. 20, 1995 [DE] Germany ..... 195 22 266
Oct. 26, 1995 [DE] Germany ..... 195 39 770

[51] Int. Cl.[6] ..... B22D 27/04

[52] U.S. Cl. ..... 164/61; 164/122.1; 164/256

[58] Field of Search ..... 164/122.1, 122.2, 164/61, 256, 258, 361

[56] References Cited

U.S. PATENT DOCUMENTS

| | | | |
|---|---|---|---|
| 3,690,367 | 9/1972 | Daniels | 164/122.1 |
| 3,897,815 | 8/1975 | Smashey | 164/122.1 |
| 4,562,943 | 1/1986 | Freytag et al. | 164/493 |
| 4,781,565 | 11/1988 | Sanjurjo | 164/418 |
| 4,969,501 | 11/1990 | Brokloff et al. | 164/122.1 |

FOREIGN PATENT DOCUMENTS

| | | | |
|---|---|---|---|
| 3046908A1 | 9/1981 | Germany . | |
| 49-16017 | 4/1974 | Japan | 164/122.1 |

*Primary Examiner*—Kuang Y. Lin
*Attorney, Agent, or Firm*—Burns, Doane, Swecker & Mathis, L.L.P.

[57] ABSTRACT

The process serves to produce a directionally solidified casting (20) and uses an alloy located in a casting mold (12). The casting mold (12) is guided from a heating chamber (4) into a cooling chamber (5). The heating chamber (4) is here at a temperature above the liquidus temperature of the alloy, and the cooling chamber (5) is at a temperature below the solidus temperature of the alloy. The heating chamber (4) and the cooling chamber (5) are separated from one another by a baffle (3), aligned transversely to the guidance direction, having an opening (7) for the casting mold (12). When carrying out the process, a solidification front (19) is formed, beneath which the directionally solidified casting (20) is formed. The part of the casting mold (12) which is guided into the cooling chamber (5) is cooled with a flow of inert gas. As a result, castings (20) which are practically free of defects are achieved with high throughput times.

25 Claims, 1 Drawing Sheet

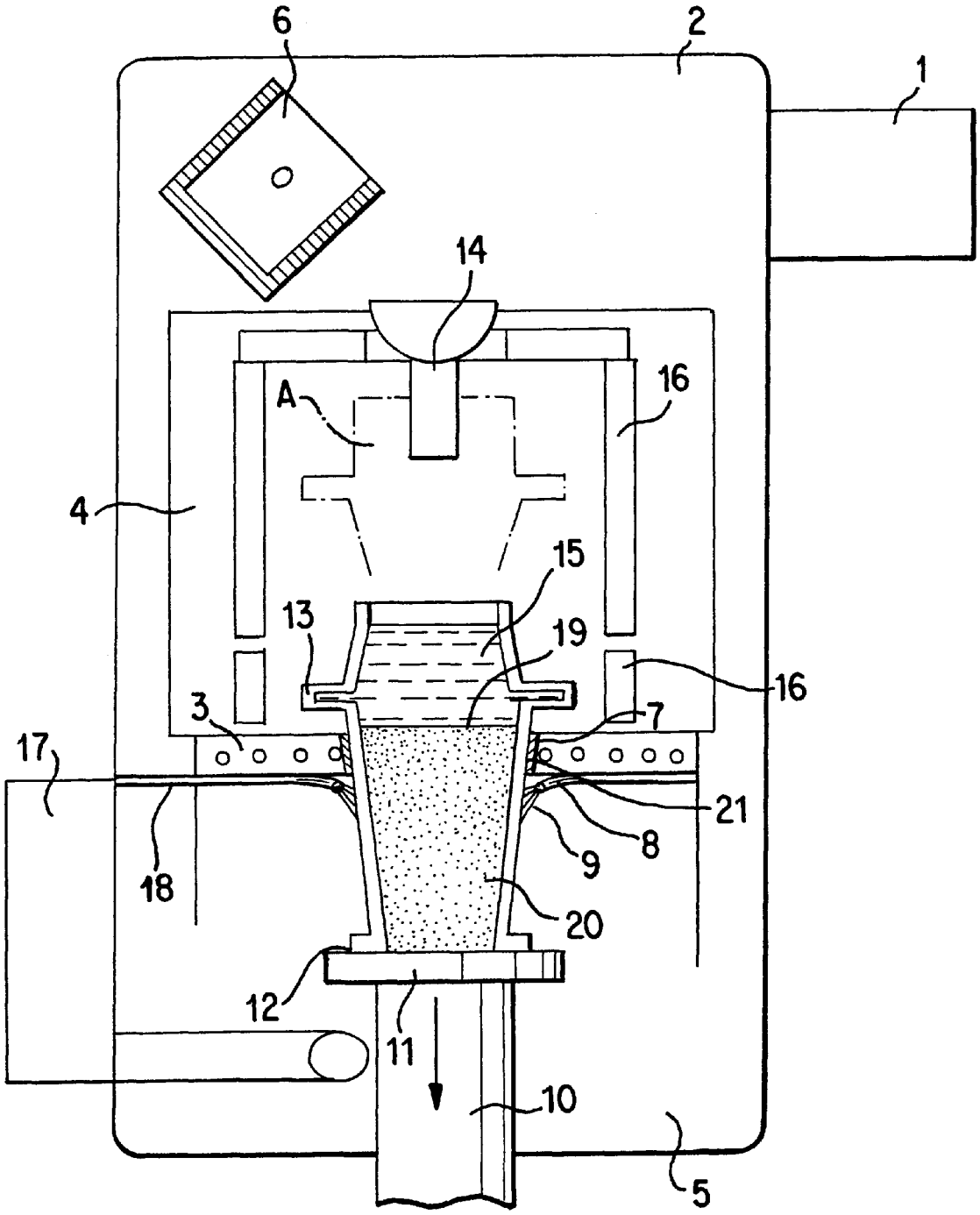
6
2
1
14
16
A
4
15
13
19
16
3
7
17
21
8
9
18
20
12
11
10
5

PROCESS FOR PRODUCING A DIRECTIONALLY SOLIDIFIED CASTING AND APPARATUS FOR CARRYING OUT THIS PROCESS

This application is a continuation of application Ser. No. 08/609,832, filed Mar. 1, 1996, now abandoned.

BACKGROUND OF THE INVENTION

1. Field of the Invention

Using processes for producing a directionally solidified casting, it is possible to produce components of a complex design which can be subjected to high thermal and mechanical stresses, such as guide vanes or rotor blades of gas turbines. Depending on the processing conditions, the directionally solidified casting can in these cases be designed as a monocrystal or be formed by columnar crystals which are aligned in a preferred direction. It is of particular importance that the directional solidification takes place under conditions in which a high level of heat exchange takes place between a cooled part of a casting mold which receives molten starting material and the starting material which is still molten. A zone of directionally solidified material can then develop, having a solidification front which migrates through the casting mold under continuing removal of heat, forming the directionally solidified casting.

The production of a sound casting depends essentially on the magnitude of the temperature gradient at the solidification front and on the rate of solidification. With a low temperature gradient and a high rate of solidification, it is not possible to produce a directionally solidified casting. By contrast, with a high temperature gradient and a low rate of solidification, it is in fact possible to produce a directionally solidified casting, but such a casting has unwanted defects, such as in particular chains of equiaxed grains (freckles).

2. Discussion of Background

The invention proceeds from a process for producing a directionally solidified casting and from an apparatus for carrying out the process as is described, for example, in U.S. Pat. No. 3,532,155. The process described serves to produce the guide vanes and rotor blades of gas turbines and using a vacuum furnace. This furnace has two chambers which are separated from one another by a water-cooled baffle and are arranged one above the other, the upper chamber of which is designed so that it can be heated and has a pivotable melting crucible for receiving material to be cast, for example a nickel base alloy. The lower chamber, which is connected to this heating chamber by an opening in the water-cooled baffle, is designed so that it can be cooled and has walls through which water flows. A driving rod which passes through the bottom of this cooling chamber and through the opening in the water-cooled baffle bears a cooling plate through which water flows and which forms the base of a casting mold located in the heating chamber.

When carrying out the process, first of all an alloy which has been liquefied in the melting crucible is poured into the casting mold located in the heating chamber. A narrow zone of directionally solidified alloy is thus formed above the cooling plate forming the base of the mold. As the casting mold is moved downward into the cooling chamber, this mold is guided through the opening provided in the water-cooled baffle. A solidification front which delimits the zone of directionally solidified alloy migrates from the bottom upward through the entire casting mold, forming a directionally solidified casting.

At the start of the solidification process, a high temperature gradient and a high rate of solidification are achieved, since the material which is poured into the mould initially strikes the cooling plate directly and the heat which is to be removed from the melt is led from the solidification front through a comparatively thin layer of solidified material, with a heat transfer coefficient $\alpha_{cm}$, to the cooling plate. If the material has a relatively low coefficient of thermal conductivity, as the distance between the cooling plate and the solidification front increases, heat is increasingly dissipated through the walls of the casting mold, with a heat transfer coefficient $\alpha_{cmd}$, and also radiated from the mold surface, with a heat transfer coefficient $\alpha_r$, into the cooler environment. In accordance with Newton's law of cooling, the heat q removed from the casting is then determined as follows:

$$q=\alpha(T-T_o),$$

where T is the average temperature of the casting and $T_o$ is the ambient temperature, as it is determined, for instance, by the water-cooled walls of the cooling chamber, and where $1/\alpha=1/\alpha_{cm}+1/\alpha_{cmd}+1/\alpha_r$.

For a large gas turbine blade made of a nickel base superalloy, the following values of the heat transfer coefficients are typically found:

$$\alpha_{cm}=\text{lambda}_m/\delta_m=816\ \text{J/m}^2\text{sK},$$

$$\alpha_{cmd}=\text{lambda}_{md}/\delta\text{md}=200\ \text{J/m}^2\text{sK},$$

where $\text{lambda}_m$ and $\text{lambda}_{md}$ are the coefficients of thermal conductivity of the alloy and of the ceramic casting mold, respectively, and $\delta_m$ and $\delta_{md}$ are the thickness of the layer of metal which has already solidified (taken as 30 mm) between the part of the mold wall situated below the water-cooled wall and the solidification front and the thickness of the mold wall (taken as 10 mm), respectively, and $\alpha_r=\sigma(\epsilon_1 T_1^4-\epsilon_2 T_0^4)/(T_1-T_0)=130\ \text{J/m}^2\text{sK}$, where $\sigma$ is the Stefan-Boltzmann constant, $\epsilon_1$, $T_1$ and $\epsilon_2$, $T_0$ are the emission capability and temperature of the casting mold surface and the absorption capability and temperature of the environment, respectively, ($\epsilon_1=\epsilon_2=0.5$; $T_1=1500$K; $T_0=400$K).

This gives $\alpha=72\ \text{J/m}^2\text{sK}$.

A further process for producing a directionally solidified casting is disclosed in U.S. Pat. No. 3,763,926. In this process, a casting mold filled with a molten alloy is gradually and continuously immersed into a tin bath heated to approximately 260° C. This achieves a particularly rapid removal of heat from the casting mold. The directionally solidified casting formed by this process is distinguished by a microstructure which has a low level of inhomogeneities. When producing gas turbine blades of comparable design, it is possible using this process to achieve a vales which are almost twice as high as when using the process according to U.S. Pat. No. 3,532,155. However, in order to avoid unwanted gas-forming reactions, which can damage the apparatus used in carrying out this process, this process requires a particularly accurate temperature control. In addition, the wall thickness of the casting mold has to be made larger than in the process according to U.S. Pat. No. 3,532,155.

SUMMARY OF THE INVENTION

Accordingly one object of the invention is to provide a process of casting directionally solidified castings, having a low number of defects, and at the same time to provide an apparatus which is advantageously favorable for carrying out this process.

The process according to the invention is distinguished by the fact that it provides directionally solidified castings which are virtually free of defects, are of a low porosity, and can be designed to be practically free of splinters even with a complex shape. In addition, the process makes rapid throughput times possible, and can also be carried out in apparatuses of the prior art, which have been retrofitted with little expenditure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein the only FIGURE shows in diagrammatic representation a preferred embodiment of an apparatus for carrying out the process according to the invention.

DESCRIPTION OF THE PREFERRED EMBODIMENT

Referring now to the drawing, the apparatus shown in the only figure has a vacuum chamber 2 which can be evacuated by means of a vacuum system 1. The vacuum chamber 2 accommodates two chambers 4, 5 which are separated from one another by a baffle (radiation shield) 3 and are arranged one above the other, and a pivotable melting crucible 6 for receiving an alloy, for example a nickel base superalloy. The upper one 4 of the two chambers is designed so that it can be heated. The lower chamber 5, which is connected to the heating chamber 4 through an opening 7 in the baffle 3, contains a device for generating and guiding a stream of gas. This device contains a cavity with orifices or nozzles 8, which point inwardly onto a casting mold 12, as well as a system for generating gas flows 9. The gas flows emerging from the orifices or nozzles 8 are predominantly centripetally guided. A driving rod 10 passing for example through the bottom of the cooling chamber 5 bears a cooling plate 11, through which water may flow if appropriate and which forms the base of a casting mold 12. By means of a drive acting on the driving rod 10, this casting mold can be guided from the heating chamber 4 through the opening 7 into the cooling chamber 5.

Above the cooling plate 11, the casting mold 12 has a thin-walled part 13, for example 10 mm thick, made of ceramic, which can accommodate nuclei promoting the formation of crystals and/or a helix initiator. By being lifted off from the cooling plate 11 or being put down on the cooling plate 11, the casting mold 12 can be opened or closed, respectively. At its upper end, the casting mold 12 is open and can be filled with molten alloy 15 from the melting crucible 6 by means of a filling device 14 inserted into the heating chamber 4. Electric heating elements 16 surrounding the casting mold 12 in the heating chamber 4 keep that part of the alloy which is located in the part of the casting mold 12 on the heating chamber side above its liquidus temperature.

The cooling chamber is connected to the inlet of a vacuum system 17 for removing the inflowing gas from the vacuum chamber 2 and for cooling and purifying the gas removed.

In order to produce a directionally solidified casting, first of all the casting mold 12 is brought into the heating chamber 4 by an upward movement of the driving rod 10 (upward position shown in dashed lines in the figure). Alloy material which has been liquefied in the melting crucible 6 is then poured into the casting mold 12 by means of the filling device 14. A narrow zone of directionally solidified alloy is thus formed above the cooling plate 11 which forms the base of the mold (not shown in the figure).

As the casting mold 12 moves downward into the cooling chamber 5, the ceramic part 13 of the casting mold 12 is successively guided through the opening 7 provided in the baffle 3. A solidification front 19 which delimits the zone of directionally solidified alloy migrates from the bottom upward through the entire casting mold, forming a directionally solidified casting 20 (Figure).

At the start of the solidification process, a high temperature gradient and a high rate of solidification are achieved, since the material which is poured into the mold initially strikes the cooling plate directly and the heat which is to be removed from the melt is led from the solidification front through a comparatively thin layer of solidified material to the cooling plate 11. When the base of the casting mold 12, formed by the cooling plate 11, has penetrated a few millimeters, for example 5 to 40 mm, measured from the underside of the baffle 3, into the cooling chamber 5, inert pressurized gas which does not react with the heated material, for example a noble gas, such as helium or argon, or another inert fluid is supplied. The inert gas flows emerging from the orifices or nozzles 8 impinge on the surface of the ceramic part 13 and are led away downward along the surface. In the process, they remove heat q from the casting mold 12 and thus also from the already directionally solidified part of the casting mold content. In accordance with the prior art according to U.S. Pat. No. 3,532,155, the heat removed is calculated as follows:

$$q=\alpha(T-T_o)$$

where T is the temperature of the casting at the solidification front and $T_o$ is the ambient temperature, as is determined by the walls of the cooling chamber 5 or of the vacuum chamber 2, and where $1/\alpha=1/\alpha_{cm}+1/\alpha_{cmd}+1/\alpha_{GCC}$, where $\alpha_{GCC}=\alpha_r$ (heat transfer by radiation)$+\alpha_{CVgas}$ (heat transfer by convection).

A particularly high level of heat removal is achieved even with a casting mold of complex design if the baffle 3 is cooled and/or if its opening 7 is delimited by flexible fingers 21 which rest against the casting mold 12.

For a large gas turbine blade made of a nickel base superalloy, the following values of the heat transfer coefficients are typically found:

$$\alpha_{cm}=\text{lambda}_m/\delta_m=816\ \text{J/m}^2\text{sK},$$

$$\alpha_{cmd}=\text{lambda}_{md}/\delta\text{md}=200\ \text{J/m}^2\text{sK},$$

where $\text{lambda}_m$ and $\text{lambda}_{md}$ are the coefficient of thermal conductivity of the alloy and of the ceramic casting mold 12, respectively, and $\delta_m$ and $\delta_{md}$ are the thickness of the layer of metal which has already solidified (taken as 30 mm) between the mold wall (situated below the baffle 3) and the solidification front and the thickness of the mold wall (taken as 10 mm), respectively, and $\alpha_{GCC}=800\ \text{J/m}^2\text{sK}$. With $\alpha=134\ \text{J/m}^2\text{sK}$, this gives a heat transfer coefficient which corresponds to that according to the process of U.S. Pat. No. 3,763,926, which is more difficult to control.

The inert gas blown into the cooling chamber 5 can be removed from the vacuum chamber 2 by the vacuum system 17, cooled, filtered and, once it has been compressed to a few bar, fed to pipelines 18 which are operatively connected to the orifices or nozzles 8.

A further casting mold can be filled with molten metal once the casting mold 12 has been removed and the vacuum chamber 2 evacuated.

The properties of castings designed as gas turbine blades which have been produced according to the processes of U.S. Pat. No. 3,532,155, of U.S. Pat. No. 3,763,926 and of the invention are specified below. These blades each had the same geometrical dimensions (length 200 mm in each case) and consisted of a nickel base superalloy with the following main components in percent by weight:

Cr=6.5; Co=9.5; Mo=0.6; W=6.5; Ta=6.5; Re=2.9; Al=5.6; Ti=1.0; Hf=0.1; Ni=remainder.

The furnace geometries, the heating temperatures and the casting temperatures were identical for all processes.

| Process | U.S. Pat. No. 3,532,155 | U.S. Pat. No. 3,763,926 | Invention |
|---|---|---|---|
| Number of blades | 8 | 8 | 4 |
| Material | ← Nickel base superalloy → | | |
| Pulling speed | 3 mm/min airfoil<br>2 mm/min root | ← 7 mm/min airfoil →<br>← 4 mm/min root → | |
| Average length of single crystal section before structure breakdown | 156 mm (single-crystal structure breakdown rupture in 6 of 8 blades) | 178 mm (single-crystal structure breakdown rupture in 2 of 8 blades) | 200 mm (no single crystal structure breakdown) |
| Slivers (average) | 1.5 | .3 | 1.5 |
| Max. porosity (vol %) | <0.9 | <0.5 | <0.6 |
| Freckles | in the root region | ← none → | |

In the processes according to U.S. Pat. No. 3,532,155 and, in particular, U.S. Pat. No. 3,763,926, the solidification front is typically concave. By contrast, in the process according to the invention the solidification front is planar or even convex. Using the process according to the invention, such a monocrystalline solidification of a turbine blade can be better implemented in the region of its inner and outer ends.

At a high throughput rate through the furnace, the process according to the invention is clearly distinguished by the fact that the castings produced therewith have a particularly high resistance to monocrystalline structure breakdown, a low porosity and no defects. Furthermore, when carrying out the process according to the invention, castings are produced which are virtually free of freckles and slivers.

Obviously, numerous modifications and variations of the present invention are possible in the light of the above teachings. It is therefore to be understood that within the scope of the appended claims, the invention may be practiced otherwise than as specifically described herein.

What is claimed is:

1. A process for producing a casting in a vacuum chamber, comprising moving a casting mold containing a liquid alloy from an upper heating chamber into a lower cooling chamber so as to directionally solidify the liquid alloy and produce a turbine component having a columnar or monocrystalline microstructure, the heating chamber being separated from the cooling chamber by a baffle provided with an opening in close proximity to an exterior surface of the casting mold, the casting mold below the baffle being additionally cooled externally with flowing inert gas which is impinging on the already solidified part of the alloy in the casting mold, the inert gas impinging the casting mold within 40 mm of an underside of the baffle.

2. The process as claimed in claim 1, wherein the gas is a mixture of argon and helium.

3. The process as claimed in claim 2, wherein the inert gas is flowed into the cooling chamber after a base of the casting mold has entered the cooling chamber.

4. The process as claimed in claim 1, wherein the inert gas is flowed in contact with the exterior surface of the casting mold and is subsequently removed from the vacuum chamber.

5. The process as claimed in claim 4, wherein the inert gas is removed from the vacuum chamber by pumping the inert gas in a direction of movement of the casting mold.

6. The process as claimed in claim 4, wherein the inert gas is removed from the vacuum chamber by suction.

7. The process as claimed in claim 1, wherein the liquid alloy comprises a nickel base superalloy and the turbine component comprises a turbine blade.

8. The process as claimed in claim 1, wherein the inert gas comprises argon, helium or mixture thereof.

9. The process as claimed in claim 1, wherein the inert gas provides a planar or convex solidification front in the casting mold.

10. The process as claimed in claim 1, wherein the turbine component is a monocrystalline turbine blade or vane.

11. The process as claimed in claim 1, wherein the alloy is a nickel-base superalloy having a nominal composition, in weight %, of 6.5% Cr, 9.5% Co. 0.6% Mo, 6.5% W, 6.5% Ta, 2.9% Re, 5.6% Al, 1% Ti, 0.1% Hf, balance Ni.

12. The process as claimed in claim 1, wherein the heating chamber includes an electric heating element adjacent the baffle maintaining the alloy in the casting mold above the liquidus of the alloy.

13. The process as claimed in claim 1, further comprising cooling the baffle.

14. An apparatus for producing a columnar or monocrystalline casting of a turbine component, the apparatus comprising a vacuum chamber, a casting mold containing a liquid alloy, a heating chamber in an upper portion of the vacuum chamber, a cooling chamber in a lower portion of the vacuum chamber, the heating chamber being separated from the cooling chamber by a baffle provided with an opening, the opening being in close proximity to an exterior surface of the casting mold, and gas nozzles below the baffle, the gas nozzles being distributed around the casting mold and directing an inert gas against a solidified part of the alloy in the casting mold, the inert gas impinging the casting mold within 40 mm of an underside of the baffle.

15. The apparatus as claimed in claim 14, wherein the casting mold is a ceramic casting mold.

16. The apparatus as claimed in claim 15, wherein the apparatus further includes a water cooled plate supporting the casting mold.

17. The apparatus as claimed in claim 14, wherein the nozzles are arranged angularly around the opening in the baffle, the nozzles being directed predominantly radially inward.

18. The apparatus as claimed in claim 14, wherein the apparatus further includes a driving rod which moves the casting mold from the heating chamber to the cooling chamber.

19. The apparatus as claimed in claim 14, wherein an upper end of the casting mold is open.

20. The apparatus as claimed in claim 14, further comprising a melting crucible in the heating chamber.

21. The apparatus as claimed in claim 20, wherein the baffle includes flexible fingers extending into the opening and resting against the casting mold.

22. The apparatus as claimed in claim 14, wherein the cooling chamber is connected to an inlet of a vacuum system for removing the gas from the cooling chamber.

23. The apparatus as claimed in claim 22, wherein the nozzles are oriented to flow the inert gas downwardly along the exterior surface of the casting mold.

24. The apparatus as claimed in claim 14, wherein the inert gas exiting the nozzles provides a planar or convex solidification front in the casting mold.

25. The apparatus as claimed in claim 14, wherein the heating chamber includes an electric heating element adjacent the baffle, the heating element maintaining the alloy in the casting mold at a temperature above a liquidus temperature of the alloy.

* * * * *